US009874016B2

(12) United States Patent
Sorkin

(10) Patent No.: US 9,874,016 B2
(45) Date of Patent: Jan. 23, 2018

(54) WEDGE FOR POST TENSIONING TENDON

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 0 days.

(21) Appl. No.: 14/838,779

(22) Filed: Aug. 28, 2015

(65) Prior Publication Data

US 2017/0016230 A1 Jan. 19, 2017

Related U.S. Application Data

(60) Provisional application No. 62/193,866, filed on Jul. 17, 2015, provisional application No. 62/193,883, filed on Jul. 17, 2015, provisional application No. 62/193,898, filed on Jul. 17, 2015.

(51) Int. Cl.
*E04C 5/12* (2006.01)

(52) U.S. Cl.
CPC ..... *E04C 5/122* (2013.01)

(58) Field of Classification Search
CPC ..... E04C 5/122
USPC ..... 52/223.13, 223.14; 403/365, 366, 367, 403/373, 374.1; 24/122.3, 122.6, 136 R
See application file for complete search history.

(56) References Cited

U.S. PATENT DOCUMENTS 3,879,147 A * 4/1975 Morell ..... 403/369
3,999,418 A * 12/1976 Morell ..... 72/377
4,318,256 A 3/1982 Boonman
4,343,122 A * 8/1982 Wlodkowski et al. .... 52/223.13
4,362,421 A 12/1982 Kelly
4,633,540 A * 1/1987 Jungwirth et al. ..... 14/22
4,648,146 A * 3/1987 Nutzel et al. ..... 14/21
4,663,907 A * 5/1987 Garcia-Mansilla Ripoll ..... 52/223.13
4,718,209 A * 1/1988 Hansen et al. ..... 52/223.13
4,896,470 A 1/1990 Sorkin
5,072,558 A 12/1991 Sorkin et al.
5,440,842 A 8/1995 Sorkin
5,701,707 A 12/1997 Sorkin
5,720,139 A 2/1998 Sorkin
(Continued)

FOREIGN PATENT DOCUMENTS

EP 0659976 A2 6/1995
FR 2582767 A1 * 12/1986 ..... E04C 5/12
(Continued)

OTHER PUBLICATIONS

International Search Report and Written Opinion issued in International Application No. PCT/US2015/047389, dated Nov. 24, 2015 (9 pages).

(Continued)

*Primary Examiner* — Charles A Fox
*Assistant Examiner* — James Buckle, Jr.
(74) *Attorney, Agent, or Firm* — Adolph Locklar

(57) ABSTRACT

A wedge assembly for post tensioning concrete includes one or more wedges and a wedge ring. Each wedge includes an outer surface having a circumferential groove formed thereon. The wedge ring is adapted to fit into the groove of the wedges and retain the wedges to a strand. The wedge ring including a gap adapted to allow the wedge ring to be installed from the side of the wedges. When installed to the strand, the wedges may form a clearance fit maintained by the wedge ring. At least one wedge may include a guide adapted to assist with the separation of the wedges when installed to the strand.

13 Claims, 6 Drawing Sheets

(56) References Cited

U.S. PATENT DOCUMENTS

| | | | | |
|---|---|---|---|---|
| 5,749,185 | A | 5/1998 | Sorkin | |
| 5,755,065 | A | 5/1998 | Sorkin | |
| 5,770,286 | A | 6/1998 | Sorkin | |
| 5,788,398 | A | 8/1998 | Sorkin | |
| 5,839,235 | A | 11/1998 | Sorkin | |
| 6,012,867 | A | 1/2000 | Sorkin | |
| 6,017,165 | A | 1/2000 | Sorkin | |
| 6,023,894 | A | 2/2000 | Sorkin | |
| 6,027,278 | A | 2/2000 | Sorkin | |
| 6,065,920 | A | 5/2000 | Becker et al. | |
| 6,098,356 | A | 8/2000 | Sorkin | |
| 6,151,850 | A | 11/2000 | Sorkin | |
| 6,176,051 | B1 | 1/2001 | Sorkin | |
| 6,234,709 | B1 | 5/2001 | Sorkin | |
| 6,381,912 | B1 | 5/2002 | Sorkin | |
| 6,513,287 | B1 | 2/2003 | Sorkin | |
| 6,557,317 | B2 | 5/2003 | Sorkin | |
| 6,560,939 | B2 | 5/2003 | Sorkin | |
| 6,631,596 | B1 | 10/2003 | Sorkin | |
| 6,761,002 | B1 | 7/2004 | Sorkin | |
| 6,817,148 | B1 | 11/2004 | Sorkin | |
| 7,424,792 | B1 | 9/2008 | Sorkin | |
| 7,676,997 | B1 | 3/2010 | Sorkin | |
| 7,716,800 | B1 * | 5/2010 | Percheron et al. | 29/413 |
| 7,752,824 | B2 * | 7/2010 | Brown et al. | 52/745.21 |
| 7,823,344 | B2 * | 11/2010 | Shin | 52/223.13 |
| 7,841,061 | B1 | 11/2010 | Sorkin | |
| 7,856,774 | B1 | 12/2010 | Sorkin | |
| 7,866,009 | B1 | 1/2011 | Sorkin | |
| 7,950,196 | B1 | 5/2011 | Sorkin | |
| 8,015,774 | B1 | 9/2011 | Sorkin | |
| 8,065,845 | B1 | 11/2011 | Sorkin | |
| 8,087,204 | B1 | 1/2012 | Sorkin | |
| 2006/0117683 | A1 * | 6/2006 | Hayes et al. | 52/223.13 |
| 2008/0302035 | A1 * | 12/2008 | Shin | 52/223.13 |

FOREIGN PATENT DOCUMENTS

| | | | | |
|---|---|---|---|---|
| GB | 804530 | A | 11/1958 | |
| WO | WO 2004094745 | A1 * | 11/2004 | E04C 5/12 |

OTHER PUBLICATIONS

American Ring, Radially Installed Retaining Rings. Archived copy from Nov. 1, 2014; Retrieved from the internet: <URL: https://web.archive.org/web/20141101222446/http://www.americanring.net/products/rings_radial.aspx>entiredocument (2 pages).

Extended European Search Report issued in Application No. 16179904.4, dated Nov. 30, 2016, 6 pages.

* cited by examiner

WEDGE FOR POST TENSIONING TENDON

CROSS-REFERENCE TO RELATED APPLICATIONS

This application is a nonprovisional application which claims priority from U.S. provisional application No. 62/193,866, filed Jul. 17, 2015; U.S. provisional application No. 62/193,883 filed Jul. 17, 2015; and U.S. Provisional Application No. 62/193,898 filed Jul. 17, 2015, each of which is hereby incorporated by reference in its entirety.

TECHNICAL FIELD/FIELD OF THE DISCLOSURE

The present disclosure relates generally to post-tensioned, pre-stressed concrete construction. The present disclosure relates specifically to wedges for anchors for use therein.

BACKGROUND OF THE DISCLOSURE

Many structures are built using concrete, including, for instance, buildings, parking structures, apartments, condominiums, hotels, mixed-use buildings, casinos, hospitals, medical buildings, government buildings, research/academic institutions, industrial buildings, malls, bridges, pavement, tanks, reservoirs, silos, foundations, sports courts, and other structures.

Pre-stressed concrete is structural concrete in which internal stresses are introduced to reduce potential tensile stresses in the concrete resulting from applied loads. This can be accomplished by two methods—post-tensioned pre-stressing and pre-tensioned pre-stressing. When post tensioning concrete, the pre-stressing assembly is tensioned after the concrete has attained a specified strength. The pre-stressing assembly, commonly known as a tendon, may include for example and without limitation, anchorages, one or more strands, and sheathes or ducts. The strand is tensioned between anchors which are embedded in the concrete once the concrete has hardened. The strand may be formed from a metal or composite or any suitable material exhibiting tensile strength which can be elongated, including, for example and without limitation, reinforcing steel, single wire cable, or multi-wire cable. The strand is typically fixedly coupled to a fixed anchorage positioned at one end of the tendon, the so-called "fixed end", and is adapted to be stressed at the other anchor, the "stressing end" of the tendon. The strand is generally held to each anchor by one or more wedges. Typically, anchors include a tapered recess which, when the strand is placed under tension, causes the wedges to further engage the strand. Wedges are typically made of metal. Typically, wedges must be assembled to or threaded onto the end of the strand once the strand is in position in the concrete member. In the case of a bridge or other elevated structure, there is a risk of dropping wedges. Additionally, as strands may extend far from the end of the structure and bend due to gravity, the ability to thread the wedge onto the end of the strand is limited. Furthermore, misalignment between the wedges during installation may damage the strand or result in an insufficient anchor between strand and the anchor.

SUMMARY

The present disclosure provides for a wedge assembly for an anchor of a tendon for post tensioning concrete. The wedge assembly may include at least one wedge adapted to fit on an outer surface of a strand of the tendon. The wedge may include an outer surface having a circumferential groove formed thereon positioned in a plane substantially perpendicular with the longitudinal axis of the strand. The wedge assembly may further include a wedge ring adapted to fit into the groove of the wedge and to retain the wedge to the strand. The wedge ring may include a gap adapted to allow the wedge ring to be installed into the groove in a direction perpendicular to the extent of the strand.

The present disclosure also provides for a method. The method may include providing an anchor for post tensioning concrete, threading a strand through the anchor, and positioning at least one wedge about the strand. The at least one wedge may include an outer surface having a circumferential groove formed thereon positioned in a plane substantially perpendicular with the longitudinal axis of the strand. The method may further include providing a wedge ring adapted to fit into the groove of the wedge and retain the wedge to the strand. The wedge ring may include a gap adapted to allow the wedge ring to be installed in a direction perpendicular to the extent of the strand. The method may further include installing the wedge ring to the wedge in a direction perpendicular to the extent of the strand by expanding the gap of the wedge ring such that the wedge passes through the gap of the wedge ring and retaining the wedge to the strand.

The present disclosure also provides for a wedge assembly for an anchor of a tendon for use in post tensioning concrete. The wedge assembly may include two or more wedges adapted to fit on an outer surface of a strand of the tendon. Each wedge may include an outer surface having a circumferential groove formed thereon. The groove may be positioned in a plane substantially perpendicular to the longitudinal axis of the strand. The wedge assembly may further include a wedge ring, the wedge ring adapted to fit into the grooves of the wedges and to retain the wedges to the strand while allowing a clearance fit between the wedges and the strand when the wedges are installed to the strand.

The present disclosure also provides for a method. The method may include providing an anchor for post tensioning concrete, threading a strand through the anchor, and providing a wedge assembly. The wedge assembly may include two or more wedges adapted to fit on an outer surface of the strand. Each wedge may include an outer surface having a circumferential groove formed thereon. The groove may be positioned in a plane substantially perpendicular to the longitudinal axis of the strand. The wedge assembly may further include a wedge ring, the wedge ring adapted to fit into the grooves of the wedges and to retain the wedges to the strand while allowing a clearance fit between the wedges and the strand when the wedges are installed to the strand. The method may further include retaining the wedges to the strand with the wedge ring such that the clearance fit is maintained.

The present disclosure also provides for a wedge assembly for an anchor of a tendon for use in post tensioning concrete. The wedge assembly may include two or more wedges adapted to fit on an outer surface of a strand of the tendon. Each wedge may include an outer surface having a circumferential groove formed thereon. The groove may be positioned in a plane substantially perpendicular to the longitudinal axis of the strand. At least one wedge may include a guide formed therein. The guide may be adapted to assist in the separation of the wedges when the wedges are installed to the strand from the side of the strand. The wedge assembly may further include a wedge ring adapted to fit into the grooves of the wedges and to retain the wedges to the strand. The wedge ring may include a gap positioned proximate the guide such that the separation of the wedge rings substantially elastically expands the wedge ring.

The present disclosure also provides for a method. The method may include providing an anchor for post tensioning concrete, threading a strand through the anchor, and providing a wedge assembly. The wedge assembly may include two or more wedges adapted to fit on an outer surface of the strand. Each wedge may include an outer surface having a circumferential groove formed thereon. The groove may be positioned in a plane substantially perpendicular to the longitudinal axis of the strand. At least one wedge may include a guide formed therein. The guide may be adapted to assist in the separation of the wedges when the wedges are installed to the strand from the side of the strand. The wedge assembly may further include a wedge ring adapted to fit into the grooves of the wedges and to retain the wedges to the strand. The wedge ring may include a gap positioned proximate the guide such that the separation of the wedge rings substantially elastically expands the wedge ring. The method may further include aligning the wedge assembly with the guide such that the guide is aligned with the strand, pressing the guide of the wedge assembly against the strand such that the wedges are separated, expanding the gap, and retaining the wedges to the strand with the wedge ring.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
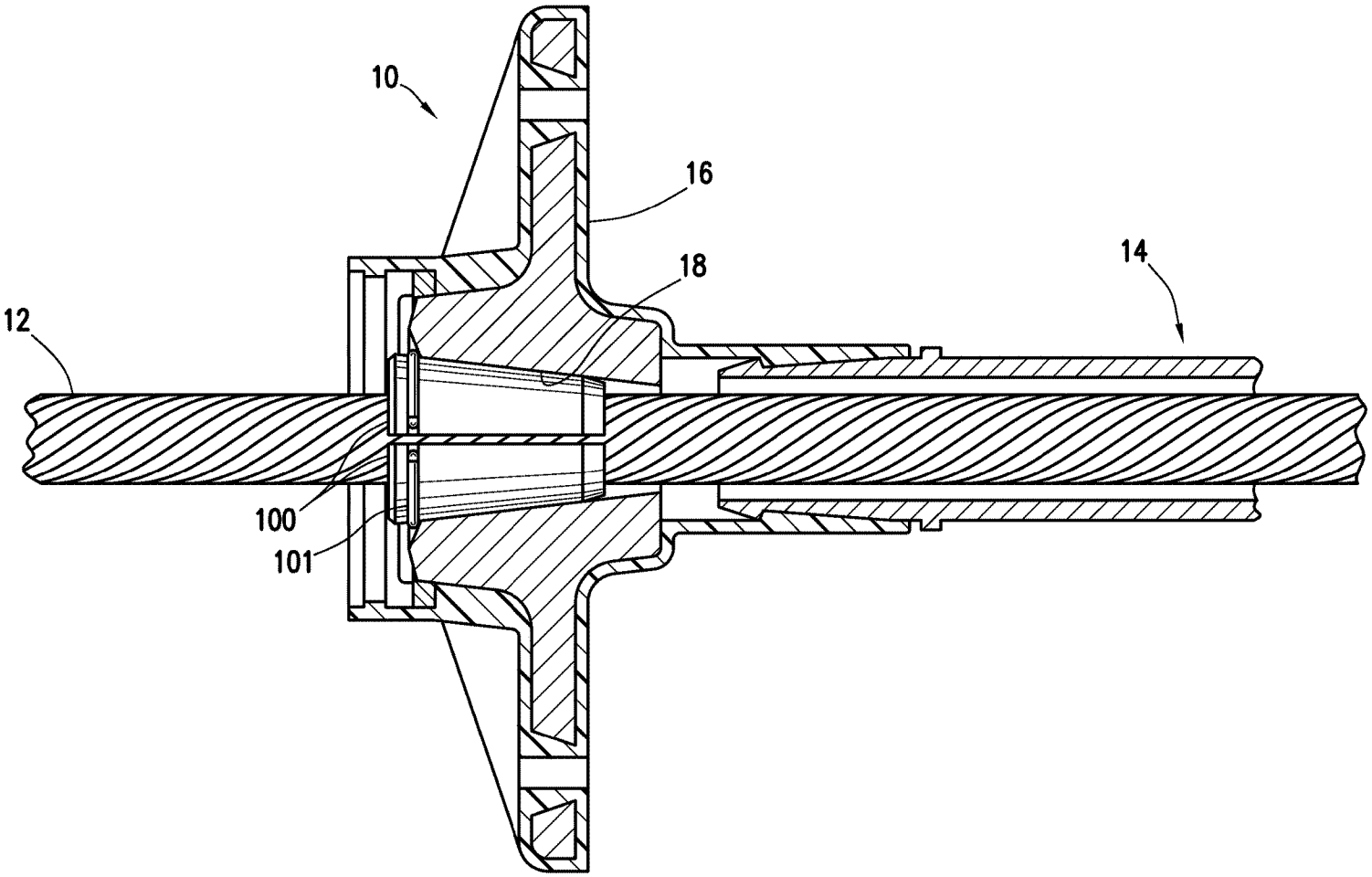
FIG. 1 depicts a cross section of an anchor having a wedge assembly consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts anchor 10 for use in post tensioning concrete. Anchor 10 is adapted to receive and couple to strand 12 of tendon 14. Strand 12 may be, for example and without limitation, mono-wire cable, or multi-wire cable. For the purposes of this disclosure, the axis parallel with the length of strand 12 will be referred to as the longitudinal axis of strand 12. Anchor 10 may include anchor body 16 adapted to retain the position of anchor 10 when positioned in formed concrete.

Anchor 10 may couple to strand 12 by the use of one or more wedges 100. Wedges 100 may be substantially wedge shaped and adapted to fit into a tapered recess 18 formed in anchor body 16. Tension on strand 12 may cause wedges 100 to move into tapered recess 18, applying a gripping force on strand 12.

Figure 2:
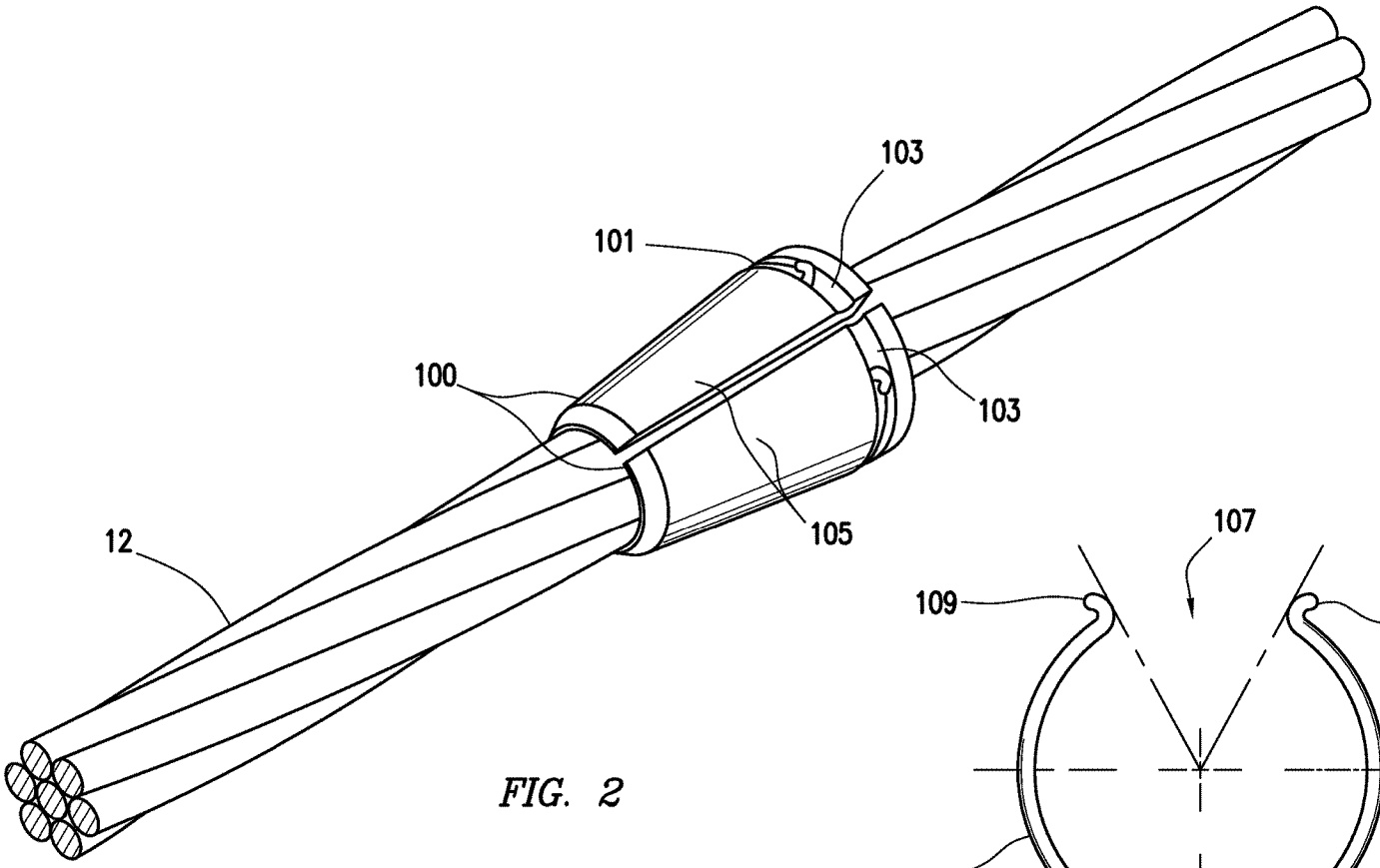
FIG. 2 depicts a perspective view of a wedge assembly consistent with at least one embodiment of the present disclosure installed onto a strand.
Figure 3:
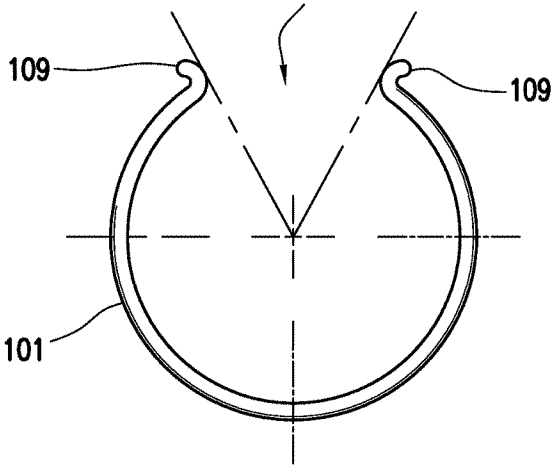
FIG. 3 depicts a top view of the wedge ring assembly of FIG. 2.

In some embodiments, wedges 100 may be coupleable by wedge ring 101. As depicted in FIG. 2, each wedge 100 may include groove 103. Groove 103 may be formed in the outer surface 105 of wedges 100 and adapted to receive wedge ring 101. Groove 103 may be formed in a plane substantially perpendicular to the longitudinal axis of strand 12. As depicted in FIG. 3, wedge ring 101 may be substantially annular and may be formed from a material capable of elastic deformation. Wedge ring 101 may include gap 107. Gap 107 may allow wedge ring 101 to be slipped into groove 103 of wedges 100 when wedges are positioned about strand 12 as depicted in FIG. 1. Wedges 100 may thus be positioned about strand 12 before being coupled by wedge ring 101, allowing wedges 100 to be coupled to strand 12 without having to thread strand 12 through wedges 100. Once wedges 100 are positioned about strand 12, wedge ring 101 may be installed to gap 107 in a direction substantially perpendicular to the extent of the strand. Wedge ring 101 may retain wedges 100 to strand 12 before tensioning of strand 12 relative to anchor 10. In some embodiments, gap 107 may be a substantially 60° opening.

In some embodiments, wedge ring 101 may include expansion features 109. Expansion features 109 may be positioned at either end of gap 107 to, for example and without limitation, allow the ends of wedge ring 101 to more easily pass over wedges 100 to allow gap 107 to expand when wedge ring 101 is installed to grooves 103 of wedges 100. In some embodiments, as depicted in FIG. 3, the ends of wedge ring 101 may include a recurve portion to facilitate expansion of wedge ring 101. In some embodiments, one or more loops or holes may be utilized to, for example and without limitation, allow a tool such as snap ring pliers to expand wedge ring 101 during installation.

Because wedge ring 101 is capable of being installed from beside wedges 100 when already installed on strand 12, wedge ring 101 does not need to be threaded onto the end of strand 12 before installation to wedges 100. Likewise, wedges 100 may be individually installed to strand 12 rather than being slipped on from the end of strand 12 as in a case where wedges 100 and wedge ring 101 were previously coupled.

Figure 4B:
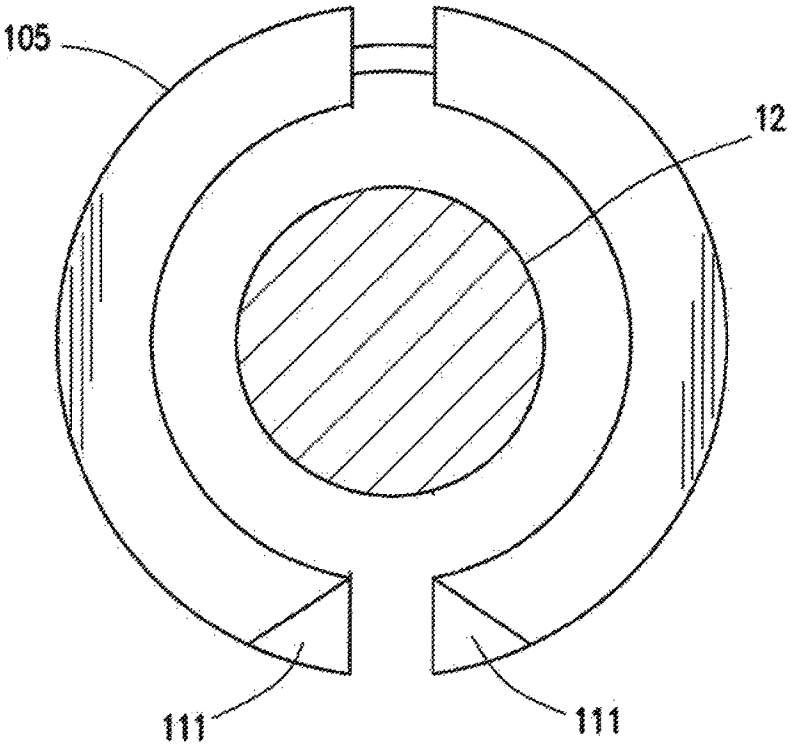
FIGS. 4A, 4B depict a wedge assembly consistent with at least one embodiment of the present disclosure.
Figure 4A:
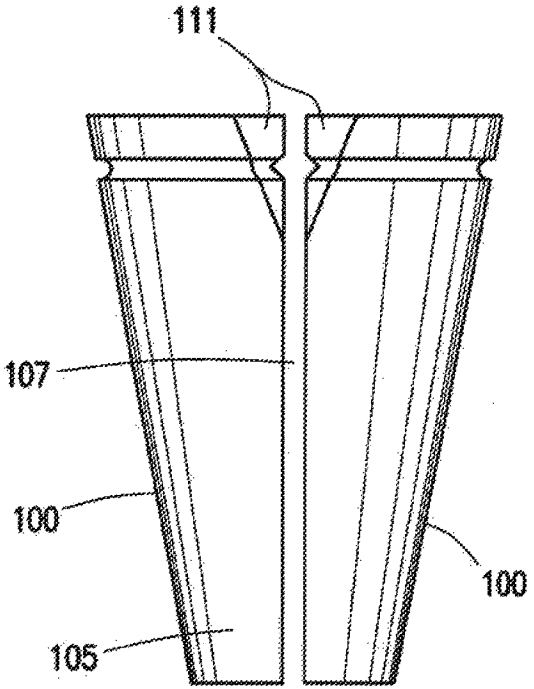

In some embodiments, as depicted in FIGS. 4A, 4B, wedges 100 may be adapted be coupled together prior to installation to strand 12 (not shown) and may include guides 111 adapted to assist with coupling wedges 100 to strand 12. Guides 111 may be positioned to, for example and without limitation, assist in expanding gap 107 by forming a tapered surface against which strand 12 may push. A portion of the force between wedges 100 and strand 12 may thus act to separate wedges 100, allowing for strand 12 to more easily enter wedges 100. Guides 111 may be one or more features positioned on at least a portion of outer surface 105 of one or more wedges 100. In some embodiments, guides 111 may, as depicted be chamfered surfaces positioned at an end of wedges 100. One having ordinary skill in the art with the benefit of this disclosure will understand that guides 111 may be any geometry known in the art including, for example and without limitation, one or more chamfers, ramps, curves, fillets, or combinations thereof. Additionally, guides 111 may be formed at locations on wedges 100 other than that shown in the present disclosure without deviating from the scope of the present disclosure.

Figure 5B:
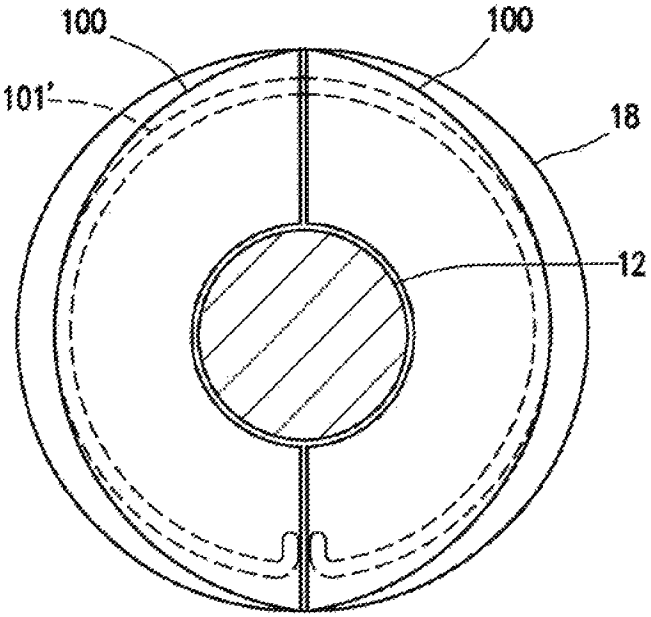
FIGS. 5A, 5B, 5C depict a wedge assembly consistent with at least one embodiment of the present disclosure.
Figure 5A:
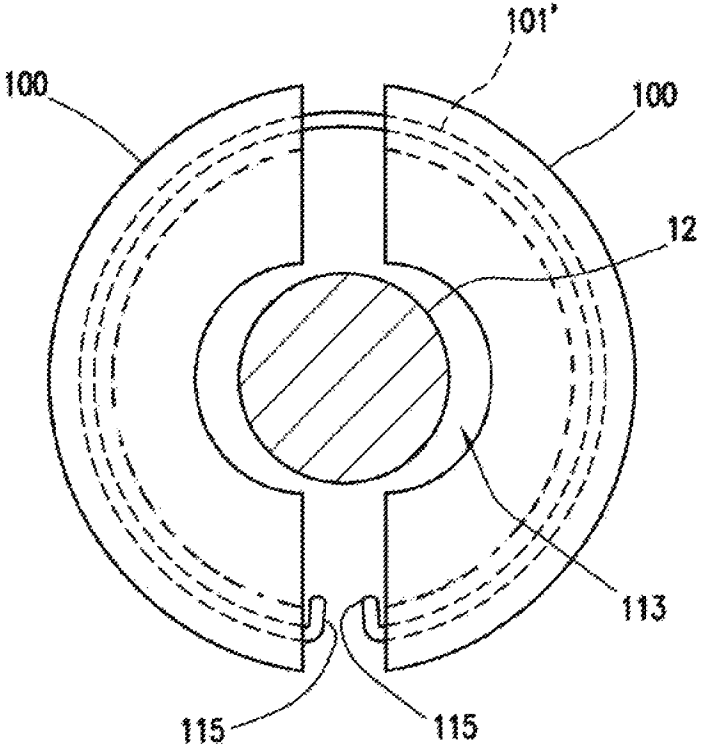
Figure 5C:
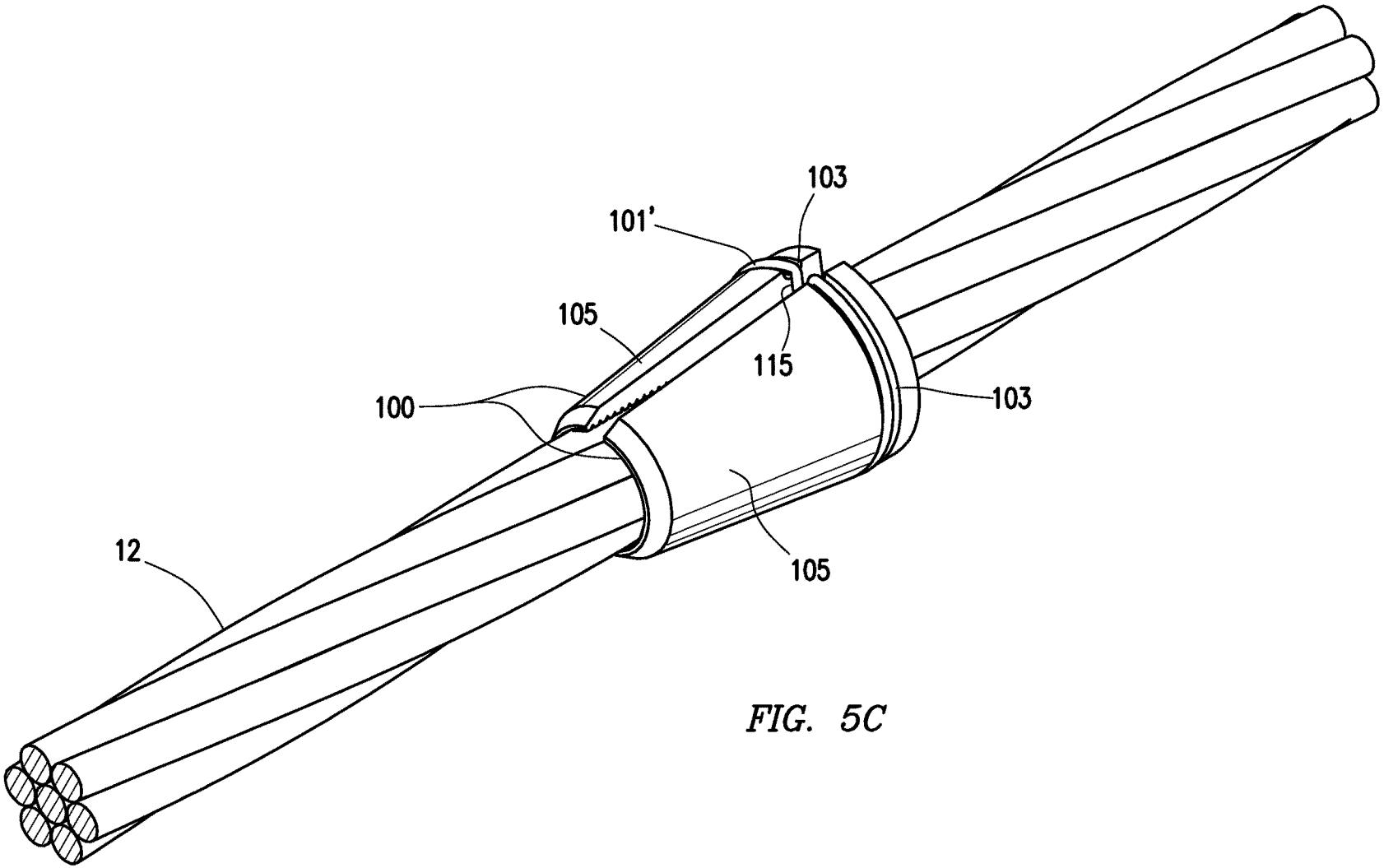

In some embodiments, wedges 100 may be formed such that once positioned on strand 12 as depicted in FIGS. 5A, 5C, wedges 100 form a clearance fit around strand 12. The clearance fit is depicted as annular space 113 in FIG. 5A and is sufficiently small that although a clearance fit is maintained, wedge ring 101' may retain wedges 100 to strand 12. The clearance fit may allow wedges 100 to more easily slide along strand 12 during installation whether installed from the end of strand 12 or from the side. Once installed to tapered recess 18 as depicted in FIG. 5B, wedges 100 may grip strand 12 as annular space 113 is closed.

Figure 5E:
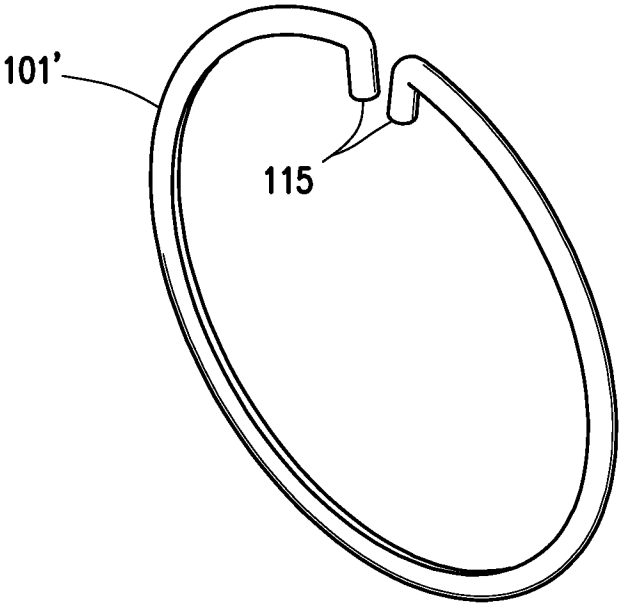
FIGS. 5D, 5E depict the wedge ring of FIGS. 5A, 5B, 5C.
Figure 5D:
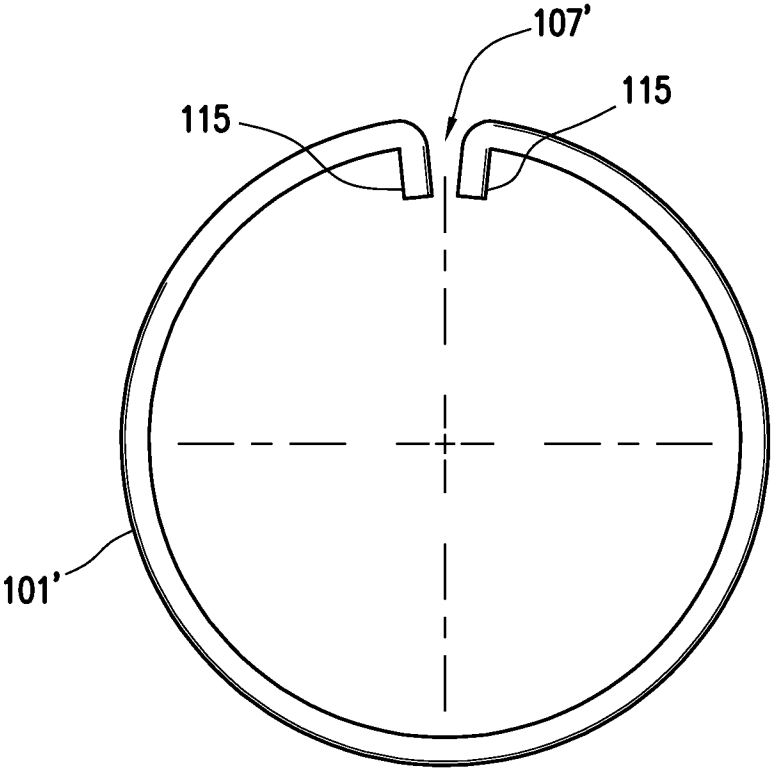

In some embodiments, as depicted in FIGS. 5A, 5D, 5E wedge ring 101' may include one or more hooks 115 adapted to maintain the clearance fit between wedges 100 and strand 12 by, for example and without limitation, maintaining separating tension on wedges 100 to maintain gap 107'. When installed to tapered recess 18 as depicted in FIG. 5B, the force applied on wedges 100 by tapered recess 18 may be sufficient to overcome the separating tension of wedge ring 101', allowing wedges 100 to grip strand 12.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A wedge assembly for an anchor of a tendon for use in post tensioning concrete comprising:

two or more wedges adapted to fit on an outer surface of a strand, each wedge including an outer surface having a circumferential groove formed thereon, the groove positioned in a plane substantially perpendicular to the longitudinal axis of the strand, a pair of the wedges defining a wedge gap therebetween; and a wedge ring, the wedge ring adapted to fit into the groove of each wedge and couple the wedges so as to form a wedge assembly, the wedge ring including a wedge ring gap adapted to allow the wedge ring to be installed into the groove;

wherein the two or more wedges and wedge ring are coupled together prior to installation to the strand, the wedge ring gap being aligned with a wedge gap so that the wedge assembly can be installed on the strand in a direction perpendicular to the longitudinal axis of the strand and installed on the strand at a position between an end of the strand and the anchor.

2. The wedge assembly of claim 1, wherein the wedge ring is adapted to be coupled to the groove in a direction substantially perpendicular to the longitudinal axis of the strand.

3. The wedge assembly of claim 1, wherein the wedge ring further comprises an expansion feature positioned at each end of the wedge ring, the expansion feature adapted to cause the gap to expand as the wedge ring is installed onto the wedge.

4. The wedge assembly of claim 3, wherein the expansion feature comprises a recurve portion.

5. The wedge assembly of claim 3, wherein the expansion feature comprises a hole adapted to operably couple to a snap ring plier.

6. A wedge assembly for an anchor for use in post tensioning concrete comprising:

two or more wedges adapted to fit on an outer surface of a strand, each wedge including an outer surface having a circumferential groove formed thereon, the groove positioned in a plane substantially perpendicular to the longitudinal axis of the strand, a pair of wedges defining a wedge gap therebetween; and a wedge ring, the wedge ring adapted to fit into the grooves of the wedges and to retain the wedges on the strand while allowing a clearance fit between the wedges and the strand when the wedges are installed on the strand, the wedge ring having a wedge ring gap aligned with a wedge gap and adapted to allow the wedges adjacent the gap to separate, thereby allowing the wedges to be installed on the strand in a direction perpendicular to the longitudinal axis of the strand and installed on the strand at a position between an end of the strand and the anchor;

wherein the two or more wedges and wedge ring are coupled together prior to installation to the strand.

7. The wedge assembly of claim 6, wherein the wedge ring is adapted to be coupled to the groove in a direction substantially perpendicular to the longitudinal axis of the strand.

8. The wedge assembly of claim 6, wherein the wedge ring further comprises one or more hooks at the wedge ring gap, the wedge ring and hooks being adapted to elastically maintain the wedge gap so as to maintain the clearance fit between the wedges and the strand.

9. The wedge assembly of claim 8, wherein, once installed in the anchor, the elastic gap maintenance of the wedge ring and hooks is overcome and the wedges couple to the outer surface of the strand.

10. A wedge assembly for an anchor for use in post tensioning concrete comprising:

two or more wedges adapted to fit on an outer surface of a strand, a pair of the wedges defining a wedge gap therebetween, each wedge including an outer surface having a circumferential groove formed thereon, the groove positioned in a plane substantially perpendicular to the longitudinal axis of the strand, at least one of the two or more wedges including a guide formed therein, the guide being adapted to assist in the separation of the first wedge and a second wedge of the two or more wedges and expansion of the wedge gap when the two or more wedges are pushed against the strand in the course of being installed on the strand from the side of the strand; and a wedge ring, the wedge ring adapted to fit into the grooves of the wedges and to retain the wedges on the strand, the wedge ring including a wedge ring gap aligned with the wedge gap such that the separation of the first and second wedges elastically expands the wedge ring;

whereby the two or more wedges and the wedge ring can be coupled together prior to installation to the strand and installed on the strand at a position between an end of the strand and the anchor.

11. The wedge assembly of claim 10, wherein the wedge ring is adapted to be coupled to the groove in a direction substantially perpendicular to the longitudinal axis of the strand.

12. The wedge assembly of claim 10, wherein the second wedge comprises a guide.

13. The wedge assembly of claim 10, wherein the guide comprises one or more chamfers, ramps, curves, or fillets.

* * * * *